US007506902B2

(12) United States Patent
Sheng et al.

(10) Patent No.: US 7,506,902 B2
(45) Date of Patent: Mar. 24, 2009

(54) AUTO-LOCK MECHANISM FOR AN IMAGE INPUT/OUTPUT DEVICE

(75) Inventors: Thomas Sheng, Hsinchu (TW); Chun-Min Wang, Hsinchu (TW)

(73) Assignee: Avision Inc. (TW)

( * ) Notice: Subject to any disclaimer, the term of this patent is extended or adjusted under 35 U.S.C. 154(b) by 171 days.

(21) Appl. No.: 11/399,823

(22) Filed: Apr. 7, 2006

(65) Prior Publication Data

US 2006/0236612 A1 Oct. 26, 2006

(30) Foreign Application Priority Data

Apr. 11, 2005 (TW) ..... 94111345 A

(51) Int. Cl.
*E05C 19/10* (2006.01)
*E05C 19/12* (2006.01)

(52) U.S. Cl. ..... 292/131; 292/11; 292/24; 292/31; 292/95; 292/130; 292/133; 292/136; 292/230; 292/231; 292/238; 292/DIG. 11; 292/DIG. 22; 292/DIG. 65; 220/263; 16/221; 49/394

(58) Field of Classification Search ..... 292/11, 292/24, 25, 28, 31, 63, 95, 96, 101–103, 292/107–110, 114, 130, 131, 133, 136, 230, 292/231, 238, DIG. 11, DIG. 17, DIG. 22, 292/DIG. 65; 220/263, 315, 324, 828, 908; 399/107, 124, 125; 16/221, 319, 343; 49/381, 49/394

See application file for complete search history.

(56) References Cited

U.S. PATENT DOCUMENTS 11,227 A * 7/1854 Ingalls ..... 49/463
36,865 A * 11/1862 Smith ..... 16/343
103,795 A * 5/1870 Struck ..... 16/343
345,048 A * 7/1886 Gordon et al. ..... 292/216
591,396 A * 10/1897 Fleming ..... 292/99
3,083,860 A * 4/1963 Van Der Werff ..... 220/264
3,719,248 A * 3/1973 Breitschwerdt et al. ..... 180/271
4,647,088 A * 3/1987 Nelson ..... 292/136
4,789,876 A * 12/1988 Miyai et al. ..... 399/108
5,738,395 A * 4/1998 Probst ..... 292/230
6,290,093 B1 * 9/2001 Obriot et al. ..... 220/835
6,510,301 B2 * 1/2003 Tanaka ..... 399/125
6,666,485 B1 * 12/2003 Moret ..... 292/130
6,802,550 B1 * 10/2004 Griggs et al. ..... 296/24.34
6,808,214 B2 * 10/2004 Sato et al. ..... 292/341.15
7,269,379 B2 * 9/2007 Nakanishi ..... 399/122
2007/0177892 A1 * 8/2007 Ikebata ..... 399/107
2007/0195381 A1 * 8/2007 Yamazaki et al. ..... 358/502

FOREIGN PATENT DOCUMENTS

GB 2269801 A * 2/1994
JP 63083323 A * 4/1988

* cited by examiner

*Primary Examiner*—Carlos Lugo

(57) ABSTRACT

An auto-lock mechanism to be mounted on an image input/output device includes a first swingable element and a second swingable element. When the image input/output device is not slantwise and an upper cover of the device is opened, one of the first and second swingable elements swings but does not hook the other of the first and second elements. When the image input/output device is slantwise, both of the first and second swingable elements simultaneously swing, approach and hook each other such that the upper cover remains closed and is free from detachment to hurt a user.

16 Claims, 7 Drawing Sheets

AUTO-LOCK MECHANISM FOR AN IMAGE INPUT/OUTPUT DEVICE

BACKGROUND OF THE INVENTION

1. Field of the Invention

The invention relates to an auto-lock mechanism, and more particularly to an auto-lock mechanism used in an image input/output device such as a scanner, a copier or a multi-function printer, wherein an upper cover can be automatically locked by the locking mechanism when the device is slantwise.

2. Prior Art

A typical image input/output device, such as a scanner, a copier or a multi-function printer, mainly includes a body and an upper cover, the upper cover can relatively be inserted into the body and opened from the body. Due to different devices having different sizes, the arrangement of various devices are not completely the same.

For example, in general, the scanner is placed on a table or a shelf. If the placement position of the scanner is flat, the scanner is not slantwise. However, when the scanner is placed on the shelf which may be reversed or shifted, or the scanner is placed on the table which may be shifted, the scanner which is placed on the table or the shelf becomes slantwise, and at this time the upper cover may be automatically opened from the body.

In addition, when the scanner is being moved, the upper cover may be automatically opened. Similarly, when the copier or the multi-function printer is being moved, the upper cover may be automatically opened due to the slantwise device.

In the above-mentioned image input/output device, two pivoting elements are disposed between the upper cover and the body, such that the upper cover can be opened or closed relative to the body. The pivoting elements may be disposed a hinge having a spring. With the reaction force of the spring of the hinge, the upper cover haves greater pressure to press on the body. However, when the upper cover is automatically opened, the reaction force of lifting the upper cover is larger than the restoring force of the spring. If the upper cover is automatically opened, the upper cover may hits the user and cause the user gets hurt, and what is more, if the force of automatically opened the upper cover is too great, the upper cover will be separated from the body and thus the image input/output device will be damaged.

Disposing at least one locking mechanism in the image input/output device can solve the problem of automatically opened the upper cover due to the slantwise of the device. A known design is to form a locking mechanism with a swingable element and a fixed element. The locking mechanism is disposed between the upper cover and the body. When the image input/output device is slantwise, the swingable element may swing to hook the fixing element and thus to keep the upper cover being fixed.

The above-mentioned design is disclosed that a movable element enables to approach a fixed element. Therefore, the stroke of locking is completed by the movable element, the total stroke and the time are longer, and the locking sensitivity is lower. Also, the locking mechanism cannot function as long as the swingable element is out of work. So, the reliability of the locking mechanism is not high.

SUMMARY OF THE INVENTION

It is therefore an object of the invention to provide an auto-lock mechanism for an image input/output device.

When the image input/output device is slantwise, the auto-lock mechanism provides an auto-locking function to automatically lock an upper cover of the image input/output device.

Another object of the invention is to provide an auto-lock mechanism for an image input/output device. When the image input/output device is slantwise, the auto-lock mechanism provides a smaller stroke for locking the upper cover. Therefore the locking sensitivity of the auto-lock mechanism is significantly enhanced.

Still another object of the invention is to provide an auto-lock mechanism for an image input/output device, wherein the auto-lock mechanism has the higher product reliability.

The invention achieves the above-mentioned objects by providing an auto-lock mechanism. The auto-lock mechanism is assembled between an upper cover and a body of an image input/output device and includes two opposite swingable elements. When the image input/output device is slantwise, the two opposite swingable elements approach each other and hook together. Thus, the upper cover can be automatically locked, and the two approaching swingable elements reduce the stroke and shorten the time of the auto-locking procedure such that the sensitivity is enhanced. Furthermore, the auto-lock function still cannot be influenced even if one of the two swingable elements is out of work, so the product reliability is higher.

DETAILED DESCRIPTION OF THE PREFERRED EMBODIMENT OF THE INVENTION

Figure 1:
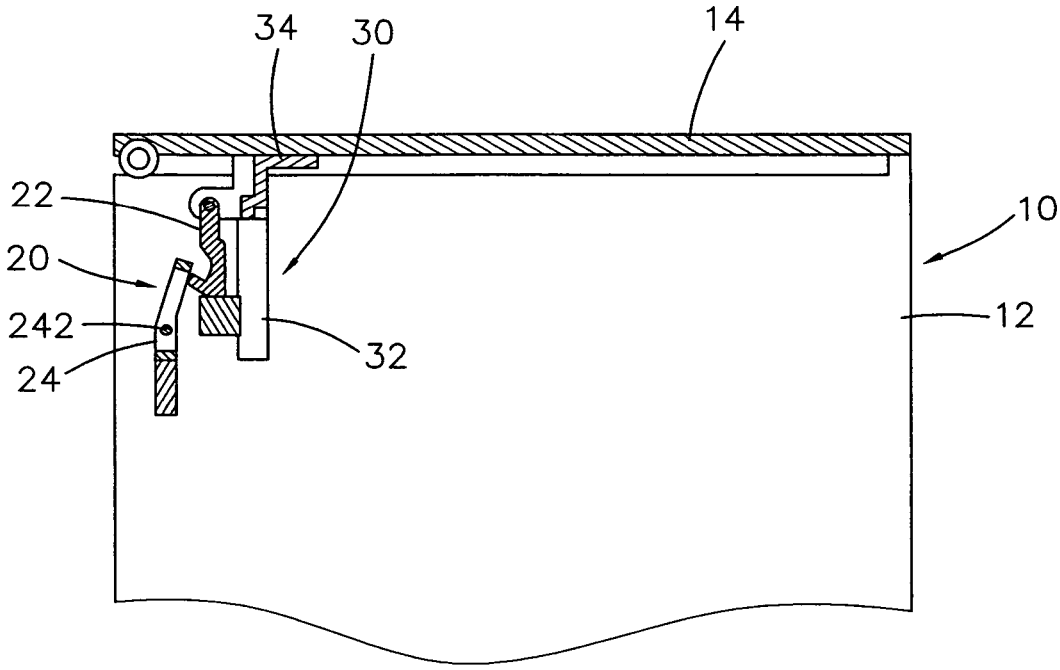
FIG. 1 is a schematic illustration showing an image input/output device of the invention.

FIG. 1 discloses a combination of an image input/output device 10 and a locking mechanism 20. The image input/output device 10 includes an upper cover 14 and a body 12 pivotally mounted on the upper cover 14 such that the upper cover 14 may be lifted and closed relative to the body. The locking mechanism 20 is attached in the body 12 or attached between the body 12 and the upper cover 14.

The pivoting between the upper cover 14 and the body 12 may be achieved through a hinge 30. The hinge 30 includes a stationary base 32 and a movable base 34, which are combined together. The stationary base 32 is disposed on the body 12 and the movable base 34 and the upper cover 14 are combined together.

Figure 2:
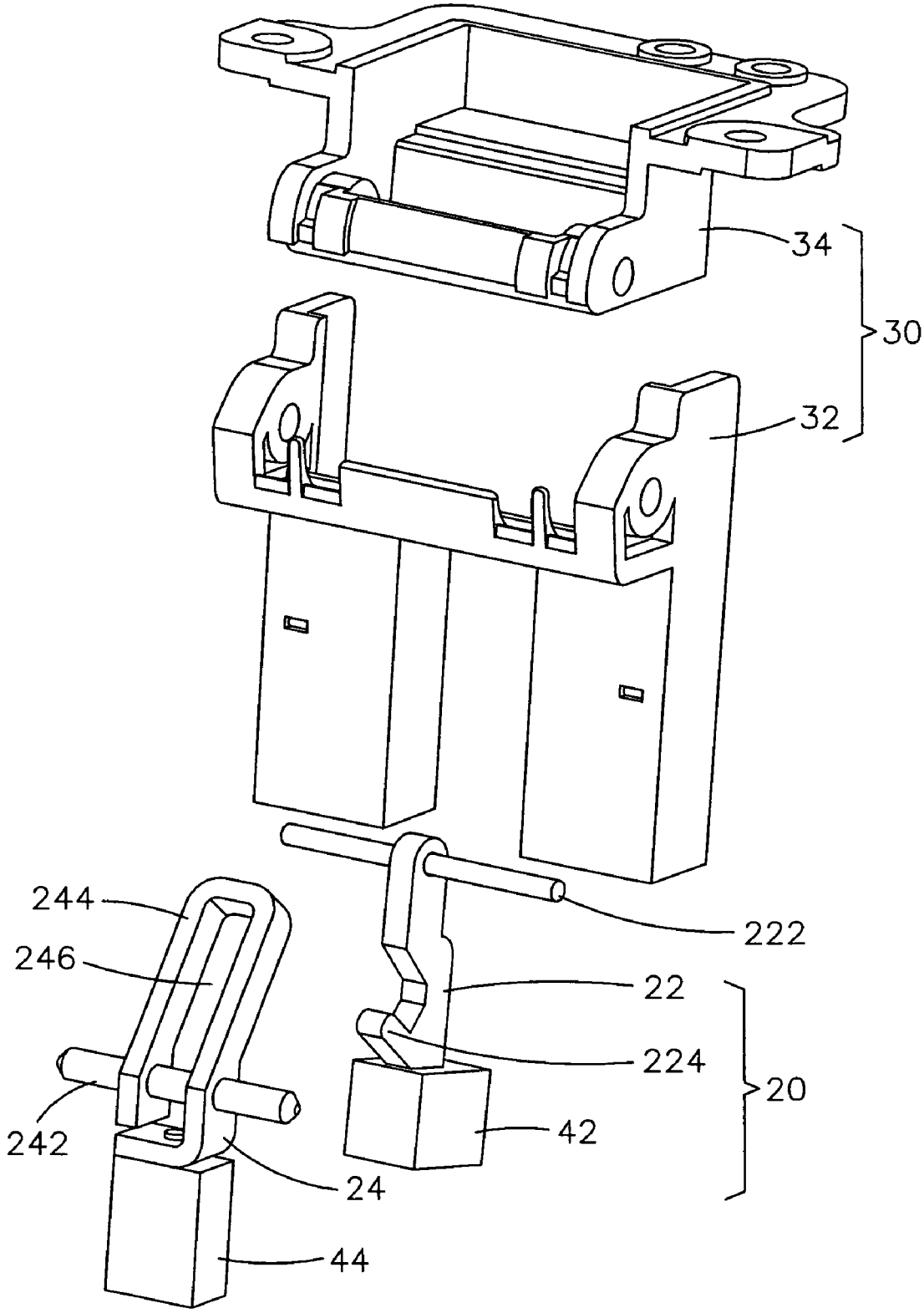
FIG. 2 is an exploded view showing an auto-lock mechanism of the invention.

Referring to FIG. 2, the locking mechanism 20 includes a first swingable element 22 and a second swingable element 24. A shaft 222 is attached to one end of the first swingable element 22, and a first fastener 224 is formed on the other end of the first swingable element 22. A first counterbalance 42 is disposed on a bottom of the first element 22 such that the first fastener 224 is located between the shaft 222 and the first counterbalance 42. The first fastener 224 is formed into a hook.

One end of the second swingable element 24 is formed with a second fastener 244, and the other end of the second swingable element 24 is attached to a second counterbalance 44. A shaft 242 is disposed between the second fastener 244 and the second counterbalance 44. The second fastener 244 is formed with an opening 246.

Figure 3:
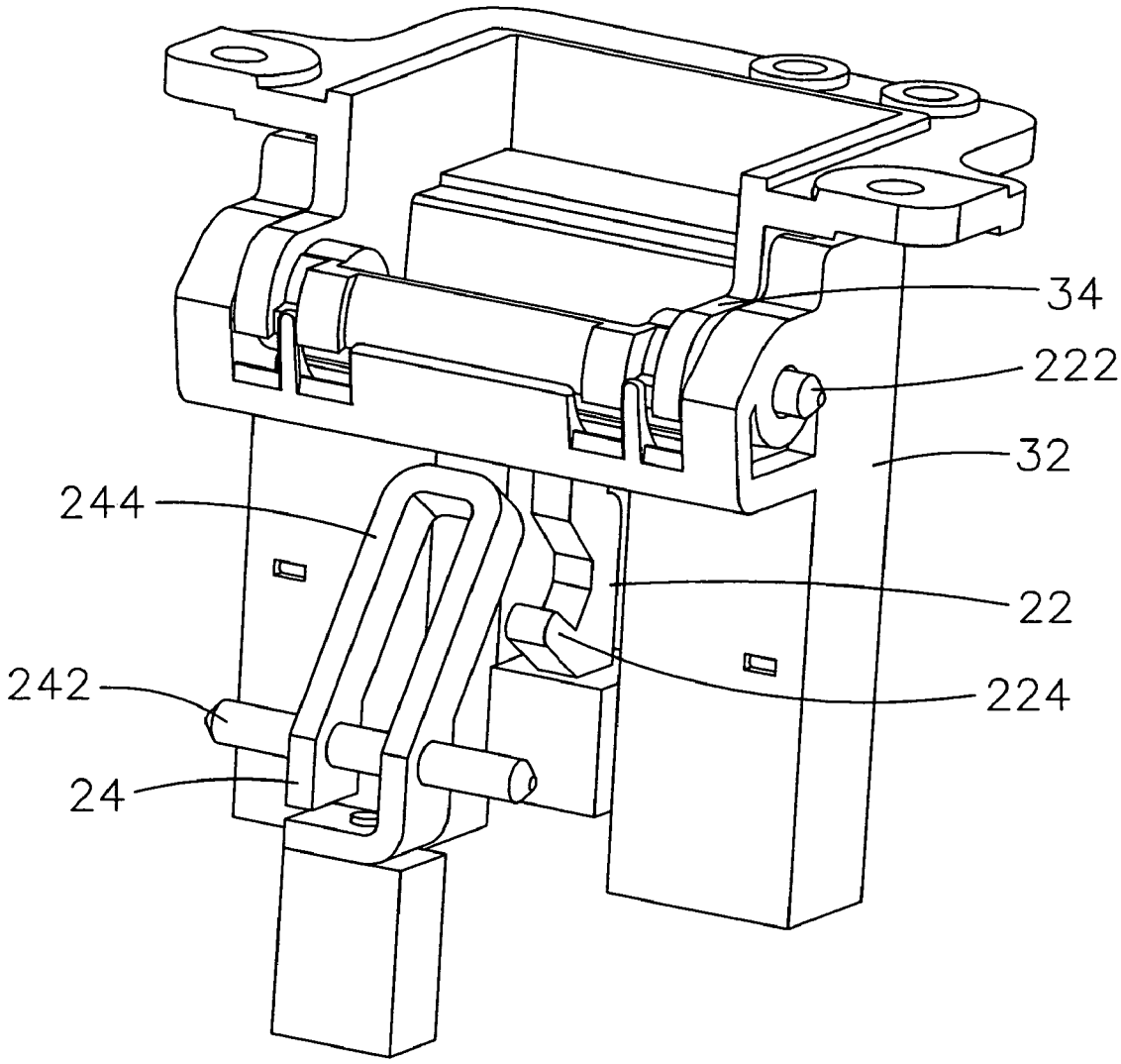
FIG. 3 is an assembled view showing the auto-lock mechanism of the invention.

Referring to FIG. 3, the first swingable element 22 is pivotally mounted on the stationary base 32 through the shaft 222, and what is more, the shaft 222 through the movable base 34 and the stationary base 32 such that the movable base 34 is pivotally mounted on the stationary base 32 and reduced number of pivoting element(s).

The second swingable element 24 is pivotally mounted at a location opposite to the first swingable element 22 through the shaft 242 attached thereon. As shown in FIG. 1, the second swingable element 24 is pivotally mounted on walls of the body 12 by the shaft 242, and the second swingable element 24 faces the first swingable element 22.

If the stationary base 32 can provide a sufficient and suitable space, the second swingable element 24 may be pivotally mounted on the stationary base 32.

As shown in FIG. 3, the first fastener 224 faces the second fastener 244 after the first swingable element 22 and the second swingable element 24 are pivotally mounted at predetermined positions.

Figure 4:
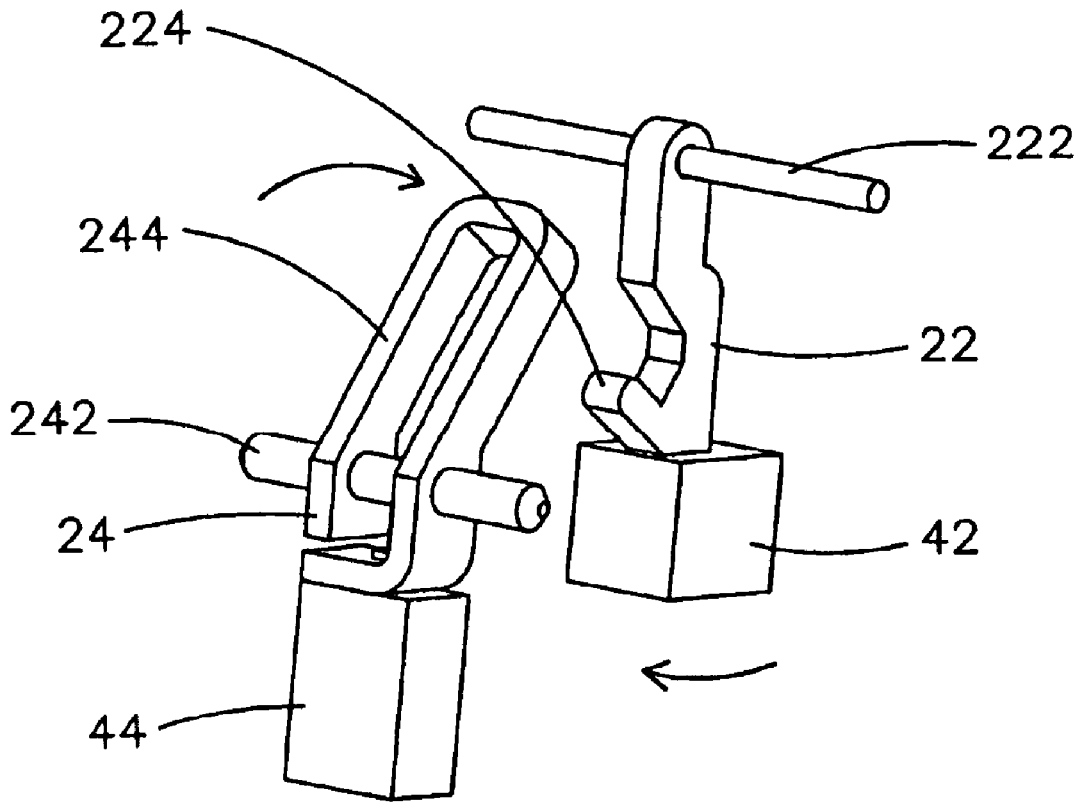
FIG. 4 is a schematic illustration showing two swingable elements which are separated from each other.
Figure 5:
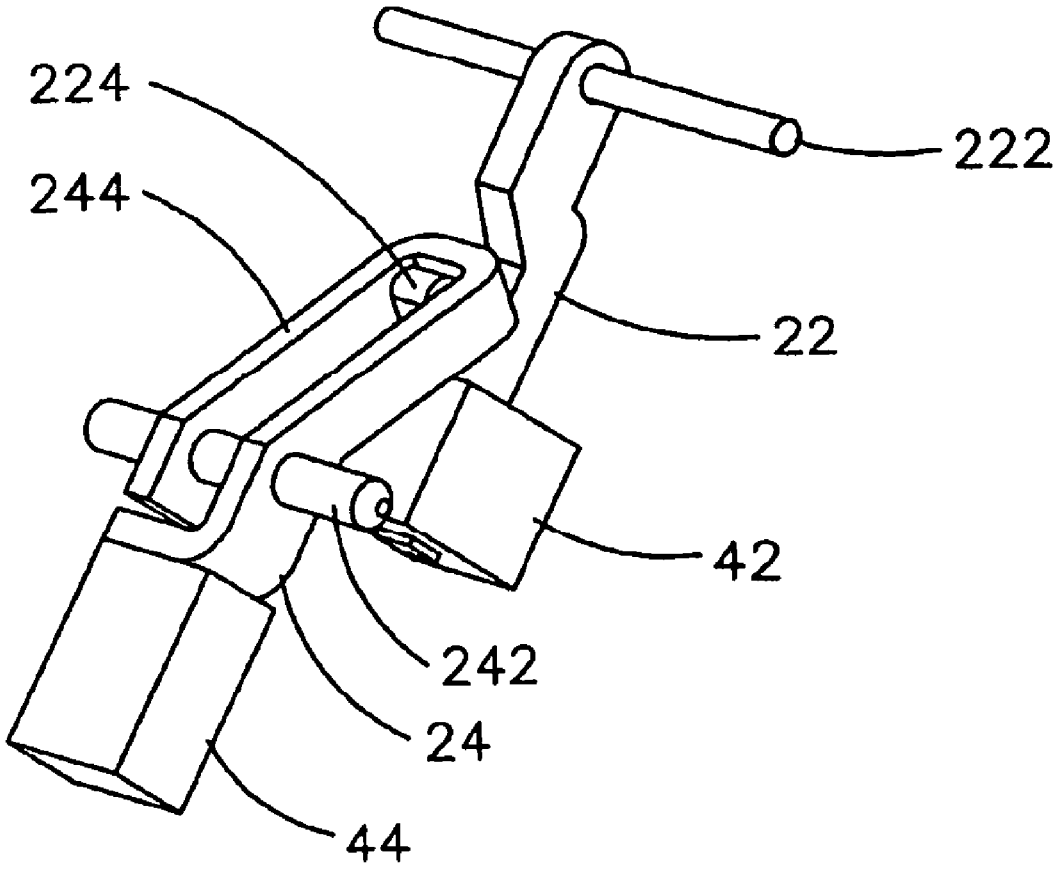
FIG. 5 is a schematic illustration showing the two swingable elements which hook together.

As shown in FIGS. 4 and 5, the first swingable element 22 and the second swingable element 24 are pivotally mounted at the predetermined positions, so the first element 22 and the second element 24 may swing by a external force. It is to be noted that the shaft 222 is attached to one end of the first swingable element 22, the shaft 242 is disposed at a middle position of the second swingable element 24, and the first counterbalance 42 and the second counterbalance 44 are located at bottom positions. So, when the first swingable element 22 and the second swingable element 24 are forced to move in the directions indicated by the arrows, the first swingable element 22 and the second swingable element 24 approach each other such that the first fastener 224 and the second fastener 244 hook together.

Figure 6:
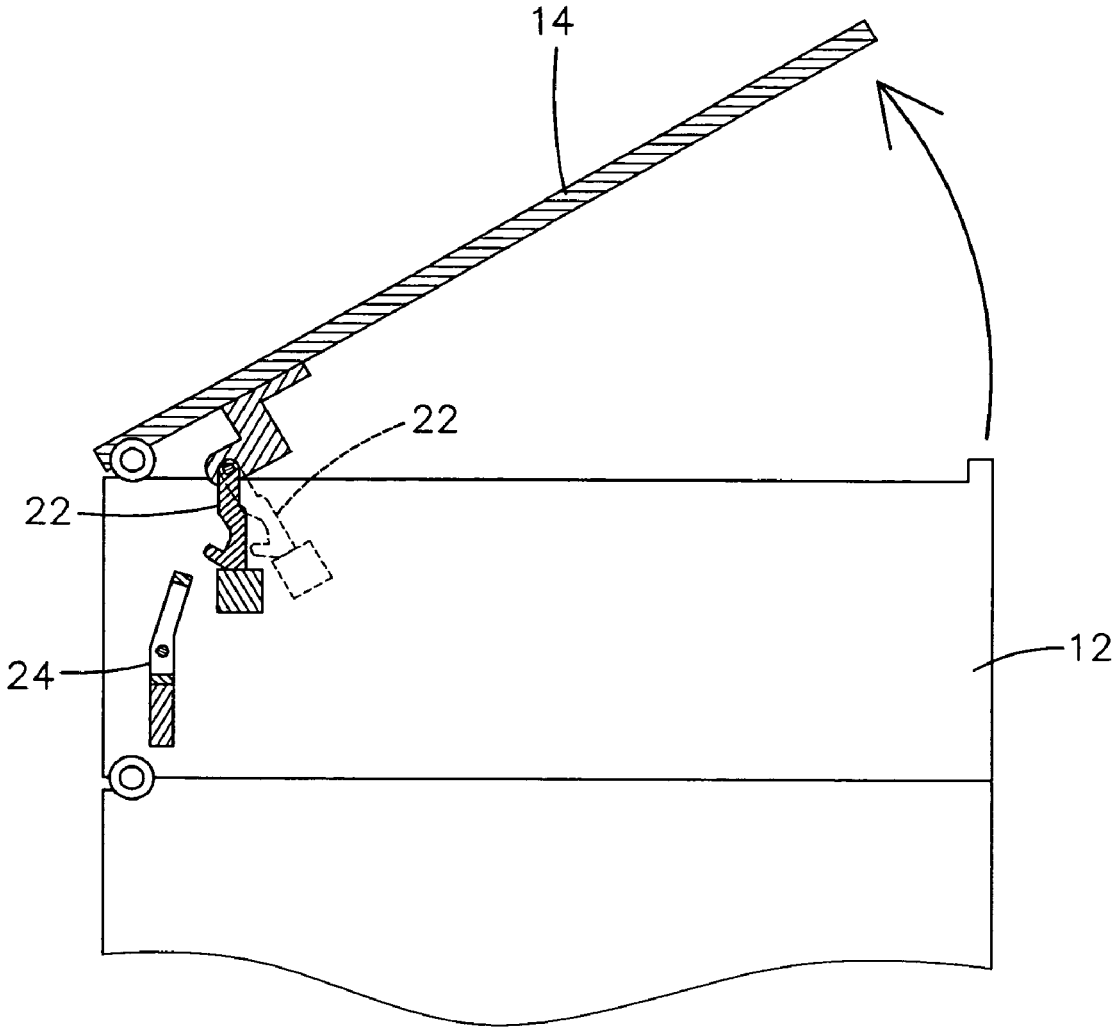
FIG. 6 is a schematic illustration showing a using state when the auto-lock mechanism is unlocked.

FIG. 6 shows the actual using state. When the body 12 is not slantwise and the upper cover 14 is lifted by an external force, Although the first swingable element 22 is moved together with the upper cover 14, the first swingable element 22 can swing, from the dashed line position to the solid line position, back to the original position due to the weight of the first counterbalance 42, and the first swingable element 22 and the second swingable element 24 do not hook together.

Figure 7:
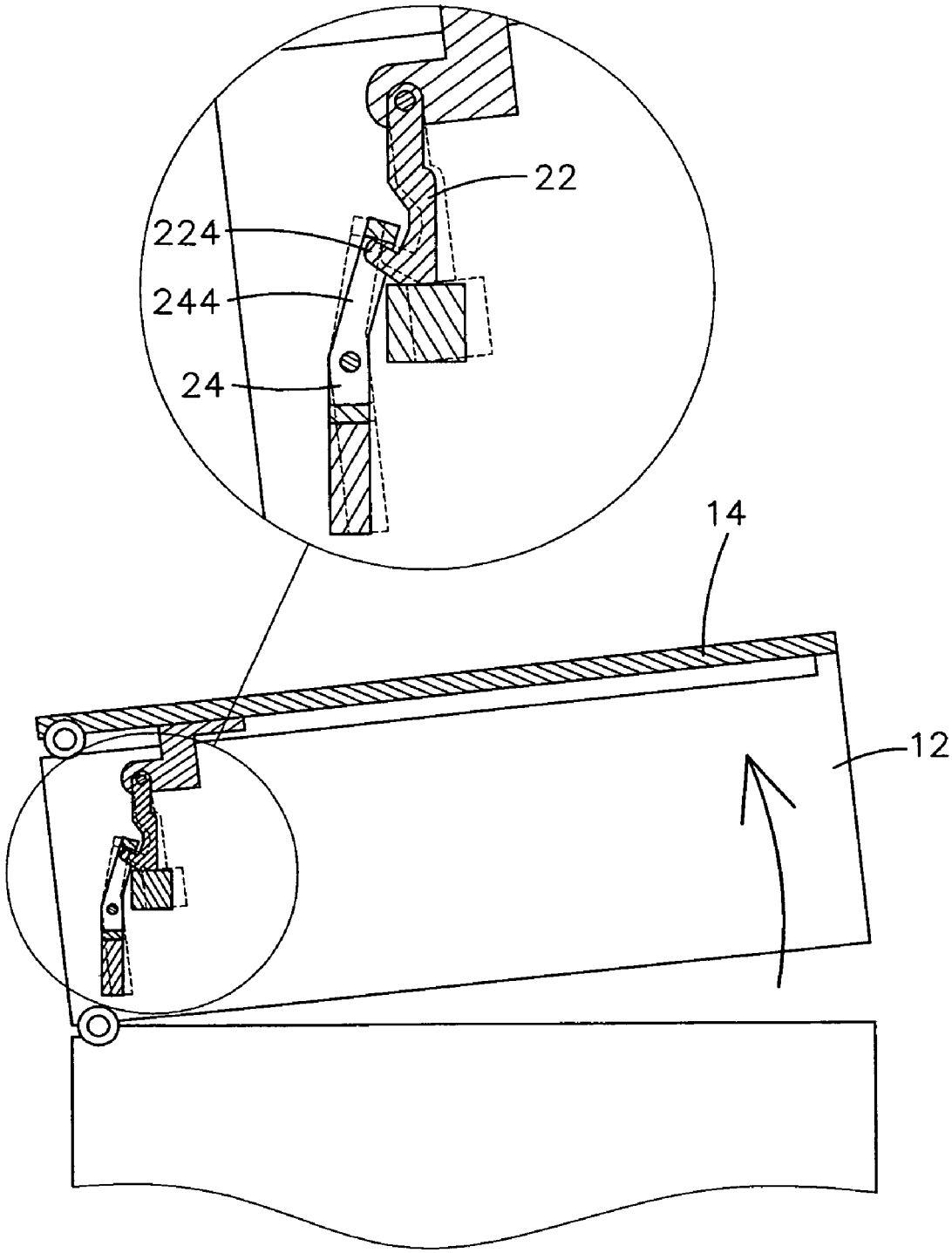
FIG. 7 is a schematic illustration showing a using state when the auto-lock mechanism is locked.

As shown in FIG. 7, when the body 12 is slantwise, the body 12 also enables the first swingable element 22 and the swingable second element 24 to swing, from the dashed line position to the solid line position, and approach each other. Because the first fastener 224 and the second fastener 244 hook together, the first swingable element 22 cannot be moved. Consequently, the upper cover 14 is locked and cannot be opened.

As shown in FIG. 5, the first fastener 224 and the first swingable element 22, which is a hook, are integrally formed, and the second fastener 244 and the second swingable element 24, which is a structure having an opening, are integrally formed. However, these structures are not particularly restricted. The first fastener 224 and the second fastener 244 are defined on condition that the hooking structures are formed on the first swingable element 22 and the second swingable element 24, and the hooking structures can hook each other. Further, the combination of the first fastener 224 and the second fastener 244 is defined as a locking assembly, wherein the fastener 224 is disposed on the first element 22 and the fastener 244 is disposed on the second element 24, and the first fastener 224 and the second fastener 244 can hook together.

According to the description of the embodiment of the invention, the invention has the following effects.

1), the upper cover can be effectively locked when the image input/output device is slantwise, such that the upper cover cannot be automatically lifted. It is possible to prevent the upper cover from hurting the user and from detachment and damage.

2), the two swingable elements of the invention can swing to approach each other, so the swinging stroke of each element can be reduced, and the time of locking can be shortened. Thus, the sensitivity of locking may be significantly enhanced.

3), because the first swingable element and the second swingable element are swingable, the locking mechanism can normally lock the upper cover even if only one swingable element can work normally. Thus, the locking mechanism of the invention has the higher product reliability.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. An auto-lock mechanism mounted between a body and an upper cover of an image input/output device, automatically locking the upper cover when the image input/output device is slantwise, the auto-lock mechanism comprising:

a first swingable element and a second swingable element, swinging relative to each other such that one end of the first swingable element and one end of the second swingable element approach each other to lock the upper cover to the body or part from each other to unlock the upper cover from the body;

a first counterbalance and a second counterbalance respectively attached to the first swingable element and the second swingable element, for providing reaction forces for swinging the first swingable element and the second swingable element, respectively; and a first fastener and a second fastener disposed on the first swingable element and the second swingable element, respectively;

wherein, when the image input/output device is slantwise, the first swingable element and the second swingable element approach each other, and the first fastener and the second fastener engage with each other such that the upper cover is fixedly locked in place.

2. The mechanism according to claim 1, wherein a shaft is mounted on the one end of the first swingable element, the first counterbalance is disposed on the other end of the first swingable element, and the first fastener is located between the shaft and the first counterbalance.

3. The mechanism according to claim 1, wherein the second counterbalance is disposed on the one end of the second swingable element, the second fastener is disposed on the other end of the second swingable element, and a shaft is disposed between the second fastener and the second counterbalance.

4. The mechanism according to claim 1, wherein the first fastener is a hook.

5. The mechanism according to claim 1, wherein the second fastener has an opening.

6. The mechanism according to claim 1, wherein the upper cover is connected to the body through a hinge, and the first swingable element is pivotally mounted on the hinge.

7. The mechanism according to claim 1, wherein the upper cover is connected to the body through a hinge, and the first swingable element and the second swingable element are pivotally mounted on the hinge.

8. The mechanism according to claim 6, wherein the hinge comprises a stationary base and the first swingable element is pivotally mounted on the stationary base.

9. The mechanism according to claim 6, wherein the hinge comprises a stationary base and the first swingable element and the second swingable element are pivotally mounted on the stationary base.

10. The mechanism according to claim 6, wherein the hinge further comprises a stationary base and a movable base pivotally mounted on the stationary base, and the first swingable element and the movable base are pivotally mounted on the stationary base through one shaft.

11. An auto-lock mechanism on an image input/output device having an upper cover, a body and at least one hinge disposed between the upper cover and the body such that the upper cover can be opened and closed, the mechanism being mounted between the body and the upper cover and capable of automatically locking the upper cover when the image input/output device is slantwise, the mechanism comprising:

a first swingable element having one end pivotally mounted on the at least one hinge and the other end formed with a first fastener;

a second swingable element pivotally mounted at a position opposite to the first swingable element and has one end formed with a second fastener; and a first counterbalance and a second counterbalance attached to the first swingable element and the second swingable element, respectively, wherein when the image input/output device is slantwise, the first counterbalance and the second counterbalance provide reaction forces, respectively swinging the first swingable element and the second swingable element, and the first swingable element and the second swingable element simultaneously swing and approach each other such that the first fastener engages with the second fastener to fixedly lock the upper cover in place.

12. The mechanism according to claim 11, wherein a shaft for pivotal mounting is attached to the one end of the first swingable element, the first counterbalance is disposed on the other end of the first swingable element, and the first fastener is located between the shaft and the first counterbalance.

13. The mechanism according to claim 11, wherein the one end of the second swingable element is formed with the second fastener, the other end of the second swingable element is attached to the second counterbalance, and a shaft is mounted between the second fastener and the second counterbalance.

14. The mechanism according to claim 11, wherein the at least one hinge has a stationary base, and the first swingable element is pivotally mounted on the stationary base.

15. The mechanism according to claim 11, wherein the at least one hinge has a stationary base and the first swingable element and the second swingable element are pivotally mounted on the stationary base.

16. The mechanism according to claim 11, wherein the at least one hinge has a movable base and a stationary base pivotally mounted on the movable base, the first swingable element is pivotally mounted on the stationary base, and the movable base and the first swingable element are pivotally mounted on the stationary base through one shaft.

* * * * *